United States Patent [19]

Meyer et al.

[11] Patent Number: 4,854,937

[45] Date of Patent: Aug. 8, 1989

[54] METHOD FOR PREPARATION OF COAL DERIVED FUEL AND ELECTRICITY BY A NOVEL CO-GENERATION SYSTEM

[75] Inventors: Edmond G. Meyer, Laramie, Wyo.; Lee G. Meyer, Englewood, Colo.

[73] Assignee: Carbon Fuels Corporation, Englewood, Colo.

[21] Appl. No.: 173,785

[22] Filed: Mar. 28, 1988

Related U.S. Application Data

[62] Division of Ser. No. 658,879, Oct. 9, 1984, abandoned.

[51] Int. Cl.[4] ..... C10L 1/32

[52] U.S. Cl. ..... 44/51; 208/414

[58] Field of Search ..... 44/51; 208/414

[56] References Cited

U.S. PATENT DOCUMENTS 4,594,140 6/1986 Cheng ..... 208/414

*Primary Examiner*—Jacqueline V. Howard

*Attorney, Agent, or Firm*—Lee G. Meyer

[57] ABSTRACT

A method for preparing a transportable fuel composition and for simultaneously producing electricity by utilizing a novel co-generation configuration. Coal or coal-derived fuels are used to generate electrical power. The waste heat from the power generation is used as the process heat for pyrolysis to produce a transportable, completely combustible slurry which contains particulate coal char and a liquid organic material.

4 Claims, No Drawings

METHOD FOR PREPARATION OF COAL DERIVED FUEL AND ELECTRICITY BY A NOVEL CO-GENERATION SYSTEM

TECHNICAL FIELD

This application is a division of U.S. patent application Ser. No. 658,879, now abandoned, which is a continuation-in-part of U.S. patent application Ser. No. 427,937 filed Sept. 29, 1982, now U.S. Pat. No. 4,475,924 issued Oct. 9, 1984, which is a continuation-in-part of U.S. patent application Ser. No. 247,382 filed Mar. 24, 1981, now abandoned. The parent application which is incorporated in its entirety by reference as if it were completely set out herein, discloses a transportable fuel system as well as a completely combustible, transportable fuel compositions derived from coal, whch compositions contain particulate coal char, and methods for making such a system.

The instant invention relates to a novel method for preparing the transportable fuel composition and for simultaneously producing electricity by utilizing a novel cogenerating configuration. Coal or coal derived fuels are used to generate electrical power and, simultaneously, to manufacture a coal derived fuel system. In one embodiment the fuel system is a transportable slurry which contains particulate coal char derived from solid carbonaceous fuels such as coal, peat lignite and lower rank coals, and the like and can be fired directly into external combustion devices such as oil and coal fired combustion systems as well as internal combustion devices such as diesels and the like. More particularly, the instant invention relates to a co-generation system which produces electricity and the waste heat is used as process heat to produce a high energy, non-polluting, fuel composition which is derived substantially from coal.

In one aspect, hot coal char and/or certain pyrolysis gases are combusted to power electrical generating turbines. The waste heat from the generation of electric power is used, in turn, as process heat in the pyrolytic process while at least some of the electricity generated is used to run the pyrolysis plant. The organic liquids derived from pyrolysis can be transported by pipeline as a feedstock or can be slurried with particulate char or coal to provide a fluidic fuel. In one aspect, the fluidic, transportable fuel can be fired directly into liquid-fueled external or internal combustion devices. In another aspect, the transportable fuel composition forms a fuel transport medium wherein some to substantially all of the particulate coal char solid is separated from the liquid component and the particulate coal char is used as a fuel for solid-fuel fired combustion devices. The hydrocarbon liquid from which the solid has been separated is used as a liquid fuel for liquid-fuel fired combustion devices or as a feedstock.

In another aspect, the organic material is used to coat the coal char which may be admixed with raw coal to produce an enhanced solid combustion fuel. The enhanced product can be subjected to compression to produce an agglomerated or pelletized product with high Btu and uniform combustion characteristics, which product can be transported by conventional means such as rail or ship.

BACKGROUND ART

The U.S. has been an inefficient energy producer and/or user for the past few decades. With the coming of the "oil crisis" in the 1970's, many modifications were made in order to more efficiently produce energy and utilize our energy resources. Special emphasis was placed on petroleum fuels and the generation of electricity.

While much has been done in the way of conservation with more efficient enggines and better, more efficient generating equipment, the U.S. is still forced to import a substantial portion of its energy needs in the form of petroleum (crude oil). Imported and domestic petroleum, as well as natural gas, are used for out large stationary and mobile combustion installations for electric power generation and production of process heat. This situation is somewhat ironic since in the United States, there if fifteen times as much recoverable coal as recoverable oil and natural gas combined. Coal, therefore, should be the primary fuel for large stationary and mobile combustion installations and for production of process heat. Not only should America's energy needs increasingly by met by coal, but coal could also meet the needs of other industrialized and developing countries. Coal could be America's answer to the balance of trade deficit caused by huge energy imports. However, such is not presently the case.

The greatest deterrent to full utilization, domestic and foreign, of the United States' coal resource is the nature of coal itself. First, raw coal is not a uniform combustion product. Second, as a solid it is difficult to handle and expensive to transport. Third, it contains organic sulfur and nitrogen, which, upon combustion, produce air pollutants which have been associated with acid rain. Fourth, it contains ash which, upon combustion, produces pollutants and slag. In addition to the above problems, the majority of the energy transportation and combustion systems in this country revolve around oil and natural gas which are relatively uniform, pipeline transportable liquid and gaseous fuels. The coal transportation and quality problems are compounded by the fact that, although coal reserves are distributed throughout the United States, coal from different reserves has a wide range of characteristics. Coals, even of the same rank, have different compositions. This limits the interchangeability of coal in combustion systems and thus increases expense and reduces markets. For example, intermountain Western coal, while low in sulfur, is also generally low in BTU per unit weight and has a high water content. Each type of coal requires different pollution control equipment and a specific boiler system. Coal of one region (or even of a particular mine) cannot be efficiently combusted in boilers designed for coal from another source. Therefore, coal is not as uniform a fuel as is, for example, #6 fuel oil.

The inefficient and expensive handling, transportation and storage of the solid material has made the conversion of oil-fired systems to coal less economically attractive. Liquids are much more easily handled, transported, stored and fired into boilers. Because of this nation's dependence on oil and natural gas, existing fuel transportation systems in the U.S., from pipelines to ocean-going tankers, are designed for liquids and gases.

Various methods, for the most part not currently economically viable, have been proposed for converting coal to synthetic liquid or gaseous fuels. Recently developed process technology permits the conversion of coal to synthetic liquid or gaseous fuels at the mine site. While this "synfuel" is more easily transported than coal, the conversion process is capital intensive and requires a great deal of water. The process is also very energy intensive in that a very large portion of the carbon atoms in the coal matrix are converted to hydrocarbons. Despite the high processing costs, the resultant synfuel, like crude oil derived fuels, is valuable as a transportation fuel.

Methods for creating coal slurries or mixtures which facilitate liquid transport and fluidic firing into boiler systems have been proposed but have not been completely successful. To produce a slurry, raw coal is ground, sized, slurried with water or other liquid, and stabilzed. The goal is to obtain a product which handles like a liquid, not only facilitating the transportation step itself, but also reducing labor costs and eliminating the many other handling problems of solids and reducing the capital costs required to convert oil-fired systems to use solid coal.

Previous coal slurries have required special pipelines and pumping equipment. Aqueous coal slurries have additional drawbacks: (1) The water which is necessary to slurry coal is in short supply for coal reserves in the intermountain West. (2) Water must be removed from the slurry and the coal must be dried prior to introduction of the fuel into a furnace or boiler to avoid incurring a substantial heat penalty. (Derating of the boiler) (3) Dewatering and disposal of the slurry water creates a pollution problem.

Liquids other than water, such as alcohol, may be used as the slurrying liquid but are expensive and usually require water for manufacture. In addition to being abrasive, coal slurries tend to settle upon standing, thereby causing flow problems in pipelines and ballast problems aboard ships.

While coal/water slurries and coal/alcohol slurries require substantial system modification in order to be fired in existing oil-fired combustion systems, coal/oil mixtures ("COM") are able to be burned in existing coal-fired furnaces, boilers and process heat generators without substantial equipment modification. COMs, which comprise a pulverized, comminuted or ground coal admixed with oil, may contain various additives to, for example, increase the wetability of the coal, stabilize the mixture, etc. This fuel mixture, while capable of being transmitted by pipeline, requires special handling and pumping equipment. These COMs have received extensive attention in the past decade but they are not new. U.S. Pat. No. 219,181, issued Feb. 24, 1879 to Smith, H. R. and Munsell, H. M. discloses the basic coal/oil mixtures and their use. COMs, while generally having a higher BTU content per unit volume than either coal or oil alone, have serrious draw backs. First, the oil used as the slurry medium draws from the U.S. domestic or foreign supply of crude oil; therefore, it only partially cuts down on this country's foreign oil dependence and reduces our balance of trade deflicit. Second, there are severe restrictions on the export of oil even as a coal/oil mixture, thus there is a limited foreign market. Third, crude oil is expensive and, with the additional slurrying expense, the cost savings to an oil-fired system are marginal. Finally, these COMs have all the inherent drawbacks of coal-containing slurries.

In order to alleviate the above problems of transporting the non-uniform, solid coal energy to the end use facility, an attempt has been made to so-called "co-generate" using electrical generating facilities. There are three main types of co-generating facilities. In all three, the facility is usually place at mine mouth, or in close proximity thereto. In the first, the coal is processed to create synthetic gas or liquid fuel which is fed to a gas turbine that generates electricity. The turbine is exhausted to a heat exchange which produces high temperature process steam. The process steam is utilized for chemical process heat or the like. In a second type, coal is burned directly in a steam boiler to produce steam which drives a turbine. The turbine generates electricity and the exhaust is used as process heat for chemical processes or the like. The third type, the so-called combined cycle cogeneration system, involves the production of synthetic gas from coal which is combusted in a gas turbine to produce electricity. The exhaust gas is heat exchanged to produce steam which drives a second electric generating turbine. The exhaust from this turbine is then used to produce process heat for a chemical plant or the like. Co-generation facilities using the syngas approach have not been altogether successful. This process requires the conversion of all or substantially all of the coal to liquid or gas, which is energy intensive and expensive. Further, as with "synfuels", the product can be a transportation fuel which is easily pipeline transportable and too expensive to be utilized in stationary units. Another disadvantage has been that the electrical facility is limited by the marketability of the process heat generated. Thus, the electric generating facility must operate in conjunction with a chemical plant or some similar process heat user. Additionally, most power generating stations are based upon economies of scale in the 400 to 500 MW range. This has proven expensive in that the capital costs for excess capacity are not justified unless the plant is utilized fully. The size of the plant also limits the sites available for co-generation facilities.

In short, the U.S. energy scene has focused on a number of individual solutions to a many-faceted problem. A fuel "systems" approach is necessary to fully utilize the nation's substantial coal reserves. By forming a modular co-generating system wherein waste heat is used to produce a carbonaceous fuel system which can be readily transported by rail or by pipeline, all of the fuel is utilized efficiently and effectively, yielding flexibility in use and distribution.

Thus it would be highly advantageous to have a co-generating system which would produce electricity while utilizing the process heat in the production of a completely combustible fluidic fuel system which is easily and efficiently prepared from coal using no external water and which would be (a) transportable using existing pipeline, tank car and tankership systems, (b) burnable either directly as a substitute for oil in substantially all existing oil-fired combustion systems with little or no equipment modification or separable at the destination to provide a liquid hydrocarbon fuel or feedstock and a burnable char, (c) a uniform combustion product regardless of the region from which the coal is obtained, (d) high in BTU content per unit volume, (e) low in ash, sulfur and nitrogen, (f) high in solid loading and stability and (g) free of polluting hy-products which would have to be disposed of at the production site or at the destination.

DISCLOSURE OF THE INVENTION

A method has now been discovered for the co-generation of electrical energy and a completely combustible, formulated fuel which can be blended to form a carbonaceous material which contains a portion of coal char; and/or enhanced by admixture with organic material derived from coal pyrolysis. Further, the blended and- /or enhanced fuel can be slurried to produce a pipeline transportable fuel system which has high BTU per unit volume, is low in pollutants, and is a substitute for petroleum derived fuel in liquid-fueled combustion systems; or it can be separated at the destination to provide a combustible solid carbonaceous fuel for solid-fueled combustion systems and a liquid portion for use in liquid-fueled combustion systems or as a feedstock. The enhanced solid fuel product can be compressed to form a pelletized product which can be fired in conventional boilers.

In the broad aspect of the invention, a co-generation configuration comprises a power generating facility having at least one electric generating device and a process heat facility for thermal conversion of coal to a coal char, organic material and a fuel gas, which process facility derives at least a portion of the process conversion heat from the waste heat produced in the generation of electrical power. In a preferred aspect, the electric generating device derives at least a portion of the generating heat from the hot coal char which is fired directly to a combustion device for driving an electrical turbine. In another aspect, the power generating facility includes an electric generating device, such as a steam turbine, which is powered by a solid carbonaceous material such as char, coal or mixtures thereof. In another aspect, the electric generating facility comprises a device at least partially powered by gases derived during the pyrolysis process or during the partial oxidation of solid carbonaceous material. Preferably, the electric power generating facility and the process facility are located proximate the mine mouth and, more preferably, adjacent one another.

The cogeneration system of the instant invention revolves around the very efficient and versatile process of pyrolytic distillation of coal in the absence of oxygen (i.e., pyrolysis) to profuce a coal char, an organic material and a hydrocarbon-containing gas. The char is a uniform, high Btu, non-polluting solid fuel while the volatile organic material, depending on pyrolysis conditions, is predominantly a liquid which contains higher boiling fractions which are separable and may be very viscous liquid or solid at room temperatures. The higher boiling organic fractions are preferably used as enhancing agents. The gases are available as raw fuel for electrical co-generation or for feedstock or for further refinement of the process.

Pyrolysis, as used herein, means the destructive distillation of coal in the absence of oxygen, and may be performed in the presence of one or more hydrocarbon donors or hydrogen itself. "Pyrolysis" thus includes pyrolysis, hydropyrolysis and steam pyrolysis as well as carbonization techniques under varying temperature, pressure and atmosphere conditions such as, for example, in the presence of hydrogen, water vapor or hydrogen-donating material.

In accordance with the instant invention, one of the "co-generated" fuels is a blended and/or enhanced solid fuel system which utilizes the uniform combusting coal char and/or the higher boiling organic materials derived from coal pyrolysis. The blended and/or enhanced material can be slurried or compressed to form a pelletized product. In one aspect, the solid fuel system of the instant invention provides a mixture of blended carbonaceous solids, at least a portion of which is coal char. In another aspect, the carbonaceous material is admixed with an amount of the organic material derived from pyrolysis effective to provide an enhanced solid fuel product. In a further aspect, the blended solid and/or enhanced fuel composition is compacted to form a pelletized or agglomerated product. In still a further aspect, it is a particulate and is slurried with water, oil or pyrolysis liquids in proportions such that it is a fluidic composition which is preferably pipeline transportable and, in some aspects, can be used as a substitute for liquid petroleum fuels. For example, in using beneficiated coal admixed with the higher boiling hydrocarbon pyrolysis liquids, one can obtain an economically transportable, non-polluting product, burnable in coal fired systems, which has a higher Btu value than the coal alone. Because the product is "coated" with the organic material, the risk of explosion is reduced, yet the fuel can be ground finely enough to be transported pneumatically. The enhanced solid fuel may be agglomerated to form pellets and transported by rail, truck or boat as well as by pneumatic means. The char produced by pyrolysis is advantageously used as part or all of the carbonaceous material.

The solid fuel systems provide a uniquely formulated or blended, uniformly burning, solid product which is economical, has high Btu per unit volume and is low in pollutants. In short, the instant fuel system is more than the mere sum of the individual components. This is accomplished primarily through the versatility of uniquely combining pyrolysis products with carbonaceous material. These solid fuel systems can be formulated by blending of various carbonaceous material constituents and/or varying the composition of the organic material. The resultant fuel not only has the desired combustion characteristics but it is superior as a fuel to the sum of the components individually. The Btu as well as the pollutant constituency can be varied and altered to match different combustion systems by blending the various constituents. Most importantly, this material is a reproducible, uniform combustion product. The organic material is used as a fuel enhancer to increase the heat value and reduce explosion hazard.

The solid fuel (blended and/or enhanced) can be slurried in, for example, water, alcohol or liquid $CO_2$ to yield a product which is substantially superior over prior art slurries. In accordance with this aspect, the carbonaceous material is ground to a particulate and sized to provide appropriate distribution and loading for the particular slurry medium used. In another aspect, the organic hydrocarbon liquid obtained from pyrolysis can be used as the slurry medium with or without the addition of other hydrocarbon containing liquids (such as alcohols derived from pyrolysis gas). In this aspect, the hydrocarbon liquid becomes part of the transportation system as well as the fuel system.

The solid carbonaceous material can be char, raw coal, upgraded coal (including lower ranked coals which are preferably dehydrated and "waste coals" which are beneficiated), petroleum coke and the like. The solid carbonaceous material preferably contains a portion of coal char. This portion can be some to substantially all of the solid material. The various carbonaceous materials are blended to yield a high Btu, reduced pollutant fuel which is superior as a fuel to each of the constituents separately. For example, beneficiated char and petroleum coke are high reactivity, high Btu products with substantially no pollutants. Coal has a lower ignition point than char while upgraded coals have higher heat content with lower ignition points. The solid blend thus can be formulated to give the burning and ignition characteristics desired.

When the solid carbonaceous material is admixed with an amount of an organic material which is at least partially derived from the pyrolysis to coal, it is enhanced. The organic fraction can further comprise liquid petroleum distillate or alcohols, such as those produced from grains or the synthesis of coal, in order to vary the characteristics of the organic material used as the solid fuel enhancer. Preferably, the organic material comprises the higher boiling fraction obtained from pyrolysis. These "tars", which are highly viscous or even solid at room temperatures, have a high heat value and "coat" the particles of carbonaceous material to prevent absorption of moisture and reduce the hazard of explosion. This is especially true with finely ground solid materials such as those acceptable for pneumatic transfer. Thus, "dried coals", including dehydrated lower ranked coals, which heretofore presented explosion hazard, are readily utilized with this invention.

In a preferred embodiment, at least a portion of the char produced by pyrolysis if fired hot into the electric generating facility and the liquid organic material, likewise produced by pyrolysis, is either mixed with the char or such liquid organic material is used alone as a liquid fuel or as a feedstock. In another aspect, the co-generation is modular in nature with the electric power generation facility being in the order of 40 to 50 MW and the process facility being sized accordingly to maximize energy usage.

In accordance with one embodiment, the particulate coal char is dispersed in the liquid organic fraction derived from pyrolysis to create a composition which has fluidic characteristics such that it can be transported by certain existing pipeline facilities and used directly in combustion systems. In one aspect, the liquid/solid mixture is a substitute for oil in oil-fired combustion devices. In another aspect, some or substantially all of the particulate coal char is separated from the fuel system at the destination for use as a fuel in char- or coal-fired combustion devices and the remaining hydrocarbon liquid is utilized as a refinery feed stock or as a high quality liquid fuel for oil fired combustion devices.

In a further aspect, the particulate coal char which has been separated from the liquid can be admixed with raw coal, upgraded coal, petroleum coke and the like to yield a high BTU, reduced pollutant fuel for char- or coal-fired combustion devices.

The liquid organic fraction, which is derived during the pyrolysis or hydropyrolysis of the coal, may be further hydrogenated to alter the viscosity. Advantageously, the liquid organic fraction may be beneficiated.

In accordance with another embodiment, the particulate coal char is admixed with a lower chain alcohol, or mixtures of such an alcohol with the liquid organic fraction, which alcohol is preferably produced by well known synthetic methods utilizing coal and water or natural gas. In accordance with a greatly preferred embodiment, the alcohol is produced from the gases liberated in the pyrolysis process and waste heat from electrical generation, thus producing all the fuel system components from a single, completely self-contained process system.

In addition to the char and liquid hydrocarbons, the pyrolysis or hydropyrolysis produces gaseous products. These gases contain combustibles, lower chain hydrocarbons, hydrogen, carbon monoxide, ammonia, sulfurous compounds and nitrogenous compounds. The gases are useful for the extraction of marketable by products such as ammonia, and for use as a hydrogen source for hydropyrolysis, as a fuel for use in cogeneration and, most importantly, as a feedstock for the production of lower chain alcohols for use as hydrocarbon slurrying liquids. Advantageously, the pyrolysis gases are "sweetened" prior to being marketed or used in the process. The elimination of potential pollutants in this manner not only enhances the value of the char and liquid hydrocarbons as non-polluting fuels but also improves the economics of the process as the gaseous products may be captured and marketed or utilized in the process. In accordance with a preferred embodiment, these gases are used primarily to produce lower chain alcohols which are admixed with the liquid hydrocarbons to improve the viscosity characteristics of the liquid hydrocarbons.

In accordance with the instant invention, the fuel system, which advantageously and synergistically comprises the transportation medium for the fuel to its end used, can be injected directly into the combustion chamber of an external combustion system in the presence of sufficient oxygen and heated to initiate and sustain combustion. The combustion products are then exhausted from the combustion chamber. Alternatively, some or substantially all of the solid can be removed from the fuel system and, either as the sole fuel or in an admixture with coal, fired directly into char- or coal-combustion devices. The remaining hydrocarbon liquids which contain the residual particulate coal char can be further used as a transportation medium to deliver the slurry for use as an oil-fired combustion ful or as a refinery feed stock.

BEST MODE FOR CARRYING OUT THE INVENTION

The method of manufacture of the instant fuel system is fully set out in the parent application of which this is a continuation-in-part. The parent application discloses that the fuel system can be utilized as a fuel composition either directly as the solid/liquid slurry or as a system which is separable into its solid and liquid components, with each constituent useful independently as a fuel or, in the case of the liquid component, a feedstock. In the interest of brevity, that application has been incorporated herein.

In accordance with the instant invention, both electricity and a highly versatile, non-polluting, fuel system, which can be effectively slurried for pipeline transport or compressed to form a pelletized product, are produced simultaneously and efficiently by utilizing the process heat of the coal pyrolysis and the "waste heat" associated with electrical power generation to provide and conserve energy in a novel "symbiotic" energy relationship. In accordance with a preferred embodiment, the co-generation configuration is located proximate the mine mouth to further effect an energy savings. In a further aspect, the electrical generating facility is of a modular nature, i.e., in the neighborhood of 40 to 50 MW as opposed to 400 MW to 500 MW which is the normal size for generation. By advantageously reducing the capacity, the capital expenditure can be reduced and the plant located at mine mouth proximate pyrolysis unit to effectively and efficiently utilized the co-generated energy. Thus, modular mine mouth stations and modular stations situated advantageously elsewhere on the "power grid", which can fire the fuel system produced by the co-generation facility can utilize the fuel of the instant invention. Since the rank of coal is not determinative in producing a uniform burning char, the mine mouth site location may be in the lignite fields of Texas, the subbituminous fields of Wyoming, or the bituminous fields of Kentucky or West Virginia. Since the mine mouth power station derives part of its energy from process heat, and the carbonaceous material (clean burning char) which is fired in the generating facility and/or the pyrolysis unit, there are few pollution problems. Additionally, the co-utilization of heat diminishes thermal pollution. Finally, the modular structure featuring reduced generating capacities reduces flue point-source emissions.

CO-GENERATION FACILITIES

The co-generation configuration of the instant invention comprise a conventional electrical power generating system containing at least one turbine for the generation of electrical energy and a pyrolysis unit adapted for the production of coal char, organic material, and a hydrocarbonrich gas wherein the "waste heat" from the electrical turbine step down is used as process heat for pyrolysis and/or the process heat generated by the pyrolysis process is used for at least a part of the energy required to drive the electrical generating turbine.

The electrical generating facilities that can be used in accordance with the instant invention are well known in the art. In a preferred embodiment, the power plant is of a combined cycle configuration. Specifically, a gas turbine cycle and a steam turbine cycle utilize the char and/or coal and the pyrolysis gases. The pyrolysis gases are combusted in the gas turbine and the char and/or coal is combusted externally to either turbine and the heat transferred to the working medium of either or both engines. Preferably, the turbine exhaust gases and the step down heat are recycled to preheat the coal in the pyrolysis step as further disclosed herein. Likewise, the hot char and/or hot char mixed with coal is combusted to generate the turbine heat. The heat of the char and gases is used to bring the fuel medium to combustion temperature. One example of such a system is disclosed in U.S. Pat. No. 4,387,560 issued June 14, 1983 to Hamilton.

In one embodiment of the instant invention, utilizing a combined cycle generating system having at least one steam turbine and at least one gas turbine, wherein the steam turbine and the gas turbine each obtain at least part of the working gas heat from an auxiliary combustor, the combustible gases and the combustible char derived from pyrolysis of coal are burned respectively in the gas turbine and the auxiliary combustor. The hot char is burned in the auxiliary combustor. The hot exhaust gases from the turbine are used to preheat the working medium gases upstream of the engine combustion chamber and to heat the stream entering the steam turbine. The working medium gases are flowed from the compressor of the gas turbine engine through a heat exchanger in the auxiliary combustor and returned to the engine combustion chamber. Working medium fluid is flowed from the condensor of the steam turbine engine through a heat exchanger in the auxiliary combustor and returned to the steam turbine. The auxiliary combustor collaterally supplies heat to the pyrolysis unit for high temperature conversion of the coal to combustible gases, char and organic liquids for a slurry medium.

This method of co-generation completely utilizes the heating value of the raw coal in powering a gas turbine engine as a result of the on-site combustion of combustible gases and combustible char. The efficiency of the combined cycle is increased by the auxiliary combustor which enables the flowing of a portion of the heating value of the coal in volatile form to the gas turbine engine and flowing the remainder of the heating value as char to the auxiliary combustor where the heating value is transferred to the gas turbine engine and the steam turbine engine. The efficiency of the pyrolysis unit is improved by transferring a portion of the heat from the working medium gases of one or both of the turbine types to provide at least a portion of the pyrolysis process heat and/or at least a portion of the heat for the coal preheating step. The efficiency of the apparatus is further enhanced by transferring a portion of the heat from the auxiliary combustor to the pyrolysis unit for conversion of the coal into combustible gases, organic material and char. In one embodiment where a fluidized bed is used for the auxiliary combustor, the bed is fluidized by the exhaust gases from the gas turbine engine. Additionally, the char, the organic material, and the hydrocarbon-rich gas are available for use in producing a novel fuel system.

PYROLYSIS

In accordance with one method for pyrolysis of coal to produce the particulate coal char and organic material that are utilized in accordance with the instant invention, raw coal is continuously crushed to particles in the range of ½" to ¼" in diameter to produce a crushed coal product. Advantageously, the crushed coalis then washed and otherwise beneficiated by means well known in the art to remove inorganics. This process and the size of the coal particle to be beneficiated will be dependent on the rank ofthe coal, its agglomerating tendencies and the inorganic sulfur and ash content of the coal. The coal is preferably preheated to remove moisture and entrained gases which are advantageously used in the process. The crushed coal is then pyrolyzed or hydropyrolyzed under temperatures and pressures and in accordance with process conditions to produce a particulate coal char. The pyrolytic destructive distillation of the coal in the absence of oxygen produces a particulate char portion, a liquid organic fraction and a hydrocarbon-rich gaseous fraction. The char portion may be further beneficiated to remove inorganic pollutants. When the char is to be used as the solid fuel in a slurry system, the char is mechanically and thermally treated to effect sizing fr bimodal and trimodal packing. The sized char mixture is then ready to be slurried.

The liquid organic fraction derived during the pyrolytic destructive distillation of the coal may be advantageously separated by fractional distillation into a higher boiling fraction containing the bulk of the nitrogen and a lower boiling fraction. The higer boiling fraction, which is a solid or a very viscous liquid, is further beneficiated and hydrogenated to decrease viscosity or sent to storage for use directly as a chemical reagent and feed stock. The lower boiling fraction is rendered substantially free of combined and entrained materials which, on combustion, would produce sulfur oxides, nitrogen oxides and like pollutants. The lower boiling fraction can be distilled to remove gasoline and other valuable hydrocarbon fractions, which can be used directly as transportation fuels. The remaining lower boiling fractin is added to the upper boiling fraction which has been hydrogenated and beneficiated for use as the medium to slurry the particulate coal char. Alternatively, the combined organic liquid can be used directly as a high quality liquid fuelor as a feedstock.

The coals that can be employed as the starting material for pyrolysis are, generally, any coal which will undergo pyrolytic destructive distillation to form a particulate coal char. In accordance with one aspect of the instant invention where the slurry liquid hydrocarbons are derived from the pyrolysis or hydropyrolysis, it will be realized by the skilled artisan that coals having lower percentages of volatiles will require use of alcohols or other "make-up" hydrocarbons to produce a pipeline transportable composition. Preferably, coal from the lignite rank to the medium volatile bituminous have sufficient volatiles so as to minimize make-up hydocarbons. When lignites are utilized, they are advantageously subjected to pretreatment to remove residual water. Lignites are an advantageous starting material in that they contain process water for hydropyrolysis as well as volatiles up to 55% by weight (on a dry basis). This is advantageous in producing char slurries having higher liquid content.

The physical properties of the coal are also important for pyrolysis. Those coals known as caking or agglomerating coals tend to form "cokes". Other coals of higher rank have plasticity and free swelling characteristics which tend to cause them to agglomerate and slake during the pyrolysis process. These coals must be subjected to special charring conditions as further set out herein to produce the particulate coal char suitable for use in accordance with the instant invention.

Specifically, the raw coal to be pyrolyzed is preferably subjected to preliminary crushing to reduce the particle size. Particle sizes of from ¼" to about ½" in lateral dimension (diameter) are found useful but the actual sizing is dependent on the properties of the coal as well as the need for beneficiation. The need for size reduction and the size of the reduced material will depend upon the process conditions utilized as well as the composition and rank of the coal material. When beneficiation is necessary, for example, with coals containing a high percentage of ash or inorganic sulfur, the coal is preferably ground and subjected to washing and beneficiation techniques. When coals are used which have agglomerating tendencies and a portion of the char is to be used in a slurried product, the size of the coal must be matched to the pyrolysis techniques and process conditions in order to produce a particulate coal char and to prevent slagging and/or agglomeration during pyrolysis. The crushing and/or grinding is preferably accomplished with impact mills such as counter-rotating cage mills, hammer mills or the like. The crushed coal is sized by, for example, rough screening and gangue material is removed to assure a more uniform product for pyrolysis. Advantageously, carbonaceous fines and the like are readily utilized and subjected directly to pyrolytic destructive distillation.

In accordance with a greatly preferred method of pyrolysis, the crushed coal particles are then passed continuously through a preheater which is operated in the range of from about 100° C. to about 220° C. at pressures from 0.1 atmospheres to 20 atmospheres in order to remove gases and moisture. In the case of coals of particular rank, vacuum and/or mechanical treatment have been found desirable for removal of water and entrained substances. The moisture isadvantageously used as process water for the hydropyrolysis and/or hydrotreating steps as further set forth herein. The entrained gases which are removed have further value as fuel for the co-generation process or as a hydrogen source for the hydropyrolysis step or as a feedback for production of lower chain alcohols. Advantageously, the preheating is carried out using process heat from the char and hot gases liberated during pyrolysis. The preheating is preferably done at lower temperatures to avoid slagging and agglomeration.

The pyrolysis step can be carried out by an y pyrolysis apparatus, which is well known in the art, having the ability to reach charring temperatures in the requisite time. For example, with subbituminous coal s, temperatures should be in the range of from about 400° C. to about 800° C. and a heating rate of from about 1.5° C. per second to about 2.5° C. per second should be employed. Coals of higher rank require progressive heating at rates which prevent agglomeration and at higher final temperatures in the range of 1000° C. depending on the atmospheric pressures. It will be realized by the skilled artisan that, depending on the composition of the charge, the residence time the pyrolysis process used and the charring furnace utilized, the temperatures and rates may vary. Preferably, the pyrolysis is performed in a continuous process.

As the crushed coal is heated in the absence of oxygen, the entrained materials are vaporized and collected. Lower boiling organic fractions including hydrocarbons, cyclics, and aromatics as well as higher boiling organic fractions are emitted from the coal leaving a particulate char material of esentially carbon which is of a porous structure and substantially spherical in shape. Included in the emitted constituents are the nitrogen containing polluting compounds such as pyridine, piperazine and the like.

The preferred method of thermal destructive distillation in the absence of oxygen is hydropyrolysis. Hydropyrolysis is advantageously employed when treating coal containing a lower percentage of volatiles or when a higher percentage of hydrocarbon liquids is desired. In accordance with this process, the pyrolysis is carried out in the presence of a hydrogen containing source which may be water or, advantageously, the pyrolysis gases which are subjected to standard phase shift reactions.

In accordance with a greatly preferred embodiment, steam pyrolysis is used with a presoak step to liberate volatiles. When steam hydropyrolysis is used, it has been found advantageous to subject the coal to pretreatment by holding the coal in the presence of a steam (water saturated) atmosphere at pressures of from about 20 to about 60 atmospheres for resident times in the range of from 15 to about 45 minutes with 30 minutes being preferred, at temperatures in the range of from about 200° C. to about 400° C. This is followed by hydropyrolysis at the same steam pressures and temperatures of from about 400° C. to about 1000° C. with temperatures in the range of from about 600° to about 800° C. being preferred for subbituminous coals. By a mechanism which is not fully understood, the steam pretreatment appears to enhance the hydropyrolization step and increase the liquid yield as well as enriching the hydrocarbon partial pressure of the liberated gases. Thus the advantage of using this method will be determined by the rank of the coal to be used as well as the rheology of final slurry product desired. The viscosity and percent loading of the fuel of the instant invention will be determined primarly by the characteristics of the transportation and combustion systems.

Both the pyrolysis and liquids hydrotreating steps are quite well developed. A number of such technologies are readily available in the art. The parametric aspects of the pyrolysis conditions determine the char yield and the yield and composition of the liquid. Of the numerous pyrolysis technologies available, three are particularly applicable to the instant invention. They are a fluidized bed; an entrained flow reactor; and the pyrolysis/hydrotreater. The last is deemed preferable when the hydrocarbon liquids are to be further treated to adjust viscosity since it allows the sequential pyrolysis of coal and hydrotreating of the liquid. In each case, the paramount consideration is to obtain a maximum amount of liquids having a viscosity consistent with producing a slurry that is capable of pipeline transport and of loading a maximum of a particulate solid coal char while being combustible in oil fired combustion systems.

In practicing pyrolysis in a continuous mode, it has been determined that recycling the hot char to the pyrolysis unit conserves energy and has a beneficial effect on the pyrolysis products. The reactor temperature and the residence time are variable factors used to produce greater yields of char and/or hydrocarbon liquids, as well as obtaining a hydrocarbon mix of desirable viscosity. The process can be "fine tuned", depending on which slurry factors are most important and on the rank of the coal (i.e., percent volatiles, agglomeration, etc.). For example, if some of the particulate char is to be separated at the destination for use as a solid fuel in solid fuel external combustion devices, higher loading factors may be desired in order to maximize the transportation of solid char.

SOLID FUEL

The pyrolysis process of the instant invention permits the "formulaton" of various solid carbonaceous materials which are derived substantially or completely from coal in order to form a solid fuel product which can be transported from the coal source to the end-use destination by the most efficient and economical transportation system available.

One aspect of the instant invention relates to a blended solid fuel system which includes a carbonaceous material, selected from raw coal, coal char, upgraded coal, dehydrated low rank coals (such as lignite and peat), petroleum coke and mixtures thereof wherein at least a part of the admixture comprises coal char derived from pyrolysis of coal in accordance with the co-generation process of the instant invention. The enhanced solid fuel composition of the instant invention can be a blend of carbonaceous materials or a single carbonaceous material, which material is admixed with an organic enhancing agent which is at least partially obtained from the pyrolysis of coal to create an enhanced or enhanced/blended composition which is a solid fuel capable of being pelletized for transport by, for example, rail or pneumatic systems or being slurried to form a fluidic fuel system. In one aspect, the solid fuel is compressed in the presence of an amount of a binding agent effective to form an agglomerated or pelletized fuel product. Advantageously, the compression is effected in the presence of heat. In another aspect, the solid particulate fuel system, when slurried with the liquid organic material, oil or water, is a substitute for oil in oil-fired combustion devices. Further, the solid particulate fuel system can be slurried with liquid carbon dioxide. In another aspect, some or substantially all of the solid material can be separated from the slurry at the destination for use as a fuel in char- or coal-fired combustion devices. In the case of organic liquid slurries, the remaining liquid organic material is utilized as a feed stock or as a high quality liquid fuel for oil fired combustion devices.; in the case of organic liquid slurries, the remaining liquid organic material is utilized as a feedstock or as a high quality liquid fuel for oil-fired combustion devices. In a further aspect, the hydrocarbonrich liquid organic fraction which is not used to enhance the carbonaceous material and/or slurry the enhanced solid fuel can be used directly as a substitute for oil in liquid-fueled combustion devices.

The chars which can be utilized in accordance with the instant invention have a high reactivity and surface area, providing exellent Btu to weight ratios. When utilized in fluidic transport systems (i.e., slurries) they are particulate in nature as distinguished from the larger, "structured" particles of the prior art. The char particles are sufficiently porous to facilitate beneficiation and combustion but the pore size is not so large as to require the use of excessive liquid for a given amount of solid. The spherical shape allows adjacent particles to "roll over" one another, therefore improving slurry rheology and enhancing the solid loading characteristics. Preferably, chars that can be employed are discrete spherical particles which typically have a reaction constant of from about 0.08 to abut 1.0; a reactivity of from about 10 to about 12; surface areas of from about 100 microns to about 200 microns; pore diameters of from about 0.02 millimicrons to about 0.07 milimicrons; and pass 100 mesh, and preferably, 200 mesh for slurry application.

The char may be beneficiated. When beneficiation is indicated because of the inorganics present, beneficiation may be utilized to clean either the raw coal, the upgraded coal or the char. The beneficiation can be performed by any device known in the art utilized to extract pollutants and other undesirable inorganics such as sulfur and ash. The char has a high degree of porosity which enables it to be readily beneficiated. Beneficiation may be accomplished, for example, by washing, jigging, extraction, flotation, chemical reaction, solvent extraction, oil agglomeration (for coal only) and/or electro-static separation. The latter three methods remove both ash and pyritic (inorganic) sulfur. When the solvent extraction or oil agglomeration method are used, it is most advantageous to utilize as the beneficiating agent the liquid derived from the pyrolysis process. The exact method employed will depend largely on the coal utilized in forming the char, the conditions of pyrolysis, and the char size and porosity.

Other carbonaceous materials that can be used include raw coal of bituminous, subbituminous and anthracite rank as well as upgraded coals, petroleum coke and the like. Preferably, coals containing higher ash and inorganic sulfur are beneficiated prior to their being used in the enhanced admixture. Upgraded coals include those which have been thermally dried or compressed under heat and mechanical pressure. The instant invention is particularly advantageous for dehydrated lower rank coals such as lignites and peats. Admixing these materials with the organic fraction to produce an enhanced fuel drastically reduces the explosion hazard of these materials. Additional upgreaded materials are those which have been treated to effect a slight carbonization of the coal (so-called carbonized coal) such as K-FUEL (process disclosed in U.S. Pat. No. 4,052,168). When coal and chars are utilized together, ignition of the coal helps to raise the temperature of certain combustion system configurations to facilitate char ignition. Additionally, use of pulverized coal is economically advantageous in that the coal portion of the fuel does not have to undergo pyrolysis.

In accordance with another aspect of the instant invention, particulate carbonaceous material, especially char produced from certain ranks of coal, may have pore sizes and absorption characteristics such that enhancing the carbonaceous material with the liquid organic "enhancing" material prior to slurrying not only reduces absorption by the solid of the liquid phase, but also increases the heat value of the solid. This treatment serves to stabilize the slurry and prevent absorption by the particulate solid of an excess of the slurry liquids. When absorption rates by the char are in the range of from about 10% to about 15% by weight, pretreatment is very beneficial. In accordance with this pretreatment, the carbonaceous material is enhanced and sealed simultaneously. Additionally, certain of these "enhancing" agents act as binding agents when the solid is to be pelletized.

The treatment is effected prior to the particulate solid being slurried with the liquid or compressed to form an agglomerated product. The enhancing agents that are useful include organic and inorganic materials which will not produce pollutants upon combustion nor cause polymerization of the liquid slurry, but increases the heat value of the solid. Since surfactants and emulsifiers are used to enhance slurry stability, care must be taken that the sealant is compatible with the stabilized composition. When the product is to be compressed, the enhancers that are useful are those which tend to "bind" or cause the individual particles to adhere to one another under compression and/or heat. Materials which are particularly advantageous include parafins and waxes as well as the longer chain aliphatics, aromatics, polycyclic aromatics, aro-aliphatics and the like. Mixtures of various hydrocarbons, such as #6 fuel oil, are particularly desirable because of their ready availability and ease of application. Advantageously, the higher boiling hydrocarbon liquids from the pyrolysis of the coal are utilized. The pyrolysis tars are particularly useful as binders. In this aspect, the hot solid material is treated with an excess of the heated, higher boiling fraction. The carbonaceous material absorbs a portion of the tar and then is coated with the excess. When pressure is applied, such as by an extruding auger or the like, the tars act as a binding agent to produce a non-absorbing, solid, enhanced, blended pelletized fuel. The enhancing agent can be applied to the solid by spraying, electrostatic deposition or the like.

In accordance with a preferred enhanced fuel embodiment, a portion of the char produced by pyrolysis of coal can be used directly, without slurrying, as a solid combustion fuel. The char is treated with an amount of the liquid organic fraction effective to enhance the combustion characteristics of the char yet maintaining the char substantially as a particulate solid matter, i.e., not a fluidic mixture. In this embodiment, preferably the higher boiling "tar" fractions are used. These fractions adhere well to the hot char and provide a "sealant to prevent moisture absorption during transport. They are also high in heat value per unit volume. For some applications, this material is advantageously pelletized. For pneumatic transport, the pellets are preferably in the order of ⅛" in outside diameter. For more conventional transport, agglomerated or molded lumps are preferably 2×0".

It will be realized that, in practicing the instant invention, addition of the organic material will cause the particles to tend to agglomerate. This is especially the case when higher boiling materials and "tars" are used. While this is advantageous when lumps of material or compressed product are desired, it is to be avoided when the material is to be slurried. It is therefore advantageous to coat the carbonaceous material while the char is hot from the pyrolysis and the higher boiling fractions are liquid. The amount of coating material absorbed will, in large respect, determine agglomeration characteristics. It will be realized that the viscosity of the coating can be reduced by addition of less viscous hydrocarbon material. Reduction of the viscosity may be necessary in order to reduce agglomeration for some applications. This is especially true when the material is to be slurried.

In accordance with the invention, when a pelletized or agglomerated product is used, it may be advantageous to use commercial binders or resins. In accordance with this aspect, thermally setting binders and/or resins or epoxides are preferred. The particular binder or resin used will depend on the end-use as well as the transportation mode.

SLURRY

If the slurry is to be fired directly into a liquid fueled combustion device, the loading and the hydrocarbon constituents and the viscosity of the liquids may be varied to maximize burner efficiency, and, in some cases, amounts of alcohol and "make up" hydrocarbon distillates can be added effective to enhance combustion characteristics in a particular combustion system configuration as well as pumping characteristics of the slurry. Hydrocarbon distillates which can be used include fractions from petroleum crudes or any artificially produced or naturally occurring hydrocarbon compound which is compatible with the coal-derived liquid hydrocarbon portion used as the slurry medium in accordance with the instant invention. These would include, without limitation, the aliphatic, cyclo-aliphatic and aromatic hydrocarbons, heterocyclics and phenols as well as multi-ring compounds, aliphatic-substituted aromatics and hydroxy-containing aliphatic-substituted aromatics. The aliphatics disclosed herein are intended to include both saturated and unsaturated compounds and their stereo-isomers. Particularly preferred are the lower chain alcohols including the mono-, di- and trihydroxy compounds. Preferably, the make-up hydrocarbons do not contain mercaptal, sulfate, sulfite, nitrate, nitrite or ammonia groups.

The solid fuel may be efficaciously sized and beneficiated. It is very important, in order to obtain the requisite liquid/solid mixture, that the solid be discrete, particulate char. When utilizing agglomerating or "caking" coals, preferably the pyrolysis process parameters are regulated so as not to produce an agglomerated product as previously set forth herein. Further, the coal char material may be emitted from the charring apparatus as discrete particles which are stuck together depending on the starting material and the pyrolysis conditions utilized. Therefore, the char material is ground to yield the substantially spherical, properly sized particulate coal char.

The carbonaceous material which is to e slurried is preferably ground and sized prior to slurrying to effect beneficial rheology characteristics. Any conventional crushing and grinding means, wet or dry, may be employed. This would include ball grinders, roll grinders, rod mills, pebble mills and the like. Advantageously, the particles are sized and recycled to produce a desired distribution of particles. This is a very important aspect of the slurry system. The char particles are of sufficient fineness to pass a 100 mesh screen and the majority of the particles pass a 300 mesh screen. The mesh sizes refer to the Tyler Standard Screens. In accordance with the instant invention, char particles in the 100 mesh range or less are preferable. It will be realized that the particulate char of the instant invention having particle sizes in the above range is important to assure not only that the solid is high in reactivity, but also that the slurry is stable and can be pumped as a fluidic fuel into external combustion systems. The exact distribution of particle sizes is somewhat empirical in nature and depends upon the characteristics of the liquid hydrocarbon.

The ground, beneficiated solid can be sized by any apparatus known in the art for separating particles of a size on the order of 100 mesh or less. Economically, screens or sieves are utilized, however, cyclone separators or the like can also be employed. In sizing, selections are made so as to assure a stable, pipeline transportable slurry and uniform combustion. A distribution of particle size is chosen to effect so called "modal" packing. The speroid shape of the primary particle provides spacing or voids between adjacent particles which can be filled by a distribution of second or third finer particle sizes to provide bimodal or trimodal packing. This modal packing technique allows addition of other solid carbonaceous fuel material to the slurry without affecting the very advantageous pumping characteristics of a particulate coal char/liquid hydrocarbon slurry. Additionally, this packing mode allows the compaction of substantially more fuel in a given volume of fuel mixture while still retaining good fluidity.

When the liquid organic fraction is to be the slurry liquid or a portion thereof, it may be hydrotreated and/or beneficiated, as necessary, to provide a lower viscosity, pollutant-free, hydrocarbon containing organic fraction. The exact amount of this fraction utilized will depend upon the desired properties of the particulate carbonaceous material or the slurry. Normally, fractions having boiling points of about 200° F. have been found useful for the instant invention. In accordance with a greatly preferred embodiment, the low boiling transportation fuels such as aviation gasoline, kerosene, naptha and the lighter diesel fuels are separated from the liquid organic fraction prior to slurrying with the particulate carbonaceous material mix. These transportation fuels can be marketed separately, thereby greatly improving the economics of the process.

The higher boiling fraction of the liquid organic fraction may contain certain sulfur and nitrogen compounds. This fraction may be removed by fractional distillation and used directly as a feedstock for chemical synthesis. Alternatively, it may be hydrotreated and beneficiated by methods well known in the art to reduce the viscosity and remove pollutants. Thus this liquid organic fraction is available as additional slurry liquid or as an "enhancer" used to coat the solid. Advantageously, the pyrolysis and hydrotreating can be accomplished sequentially, followed by beneficiation in accordance with the procedure previously disclosed herein.

The particulate carbonaceous material and the lower viscosity pollutant-free organic fraction and the hydrotreated higher boiling fraction are admixed in the desired portion to form a slurry. An admixture is thus formed of a particulate carbonaceous material and the organic liquid constituent having a ratio of particulate to liquid which is dependent upon the properties of the slurry desired. The exact mixture of liquid to solid will depend on a number of factors such as the characteristics of the liquid-fueled combustion device in which it is to be used, the transportation medium and the like. The transportable, fluidic fuel composition is passed to storage for later distribution by pipeline or tanker vehicle in a manner similar to crude oil.

The terms "slurry" or liquid/solid mixture" as used herein are meant to include a composition having an amount of the particulate carbonaceous material in excess of that amount which is inherently present in the liquid organic portion as a result of the pyrolysis process. For most applications, however, the particulate coal char constituent should comprise not less than about 45% by weight of the composition and preferably from about 45% to about 75% by weight. In accordance with one aspect wherein the char is separated from the liquid at the slurry destination, the term 'slurry' is intended to include a composition containing amounts of char as low as 1% by weight, which composition may be further transported, for example by pipeline, to a refinery or to another combustion facility.

In accordance with another embodiment of the instant invention, coal and water or, more preferably, the pyrolysis gases are utilized to produce methanol and other lower chain alcohols which are utilized as the liquid phase for the combustible fuel admixture of the instant invention. Water released from the coal during preheating can be used as part of the water required in the synthesis, thus further preserving precious resources.

As used herein the term alcohol is employed to mean alcohols (mono-, di- and trihydroxy) which contain from 1 to about 4 carbon atoms. These include, for example, methanol, ethanol, propanol, butanol and the like. The alcohol may range from substantially pure methanol to various mixtures of alcohols as are produced by the catalyzed reaction of gases from pyrolysis or natural gas. Advantageously, the alcohol constituent can be produced on site at the mine in conjunction with the pyrolytic destructive distillation. The process heat can be supplied from the pyrolysis step.

In accordance with the process for making these alcohols directly from coal and steam, carbon monoxide and hydrogen are initially formed in accordance with equation I:

$$HOH(steam) + C(coal) \rightarrow CO + H_2. \quad \text{TM I.}$$

A portion of the gas is subjected to the shift reaction with steam to produce additional hydrogen in accordance with equation II:

$$CO + HOH(steam) \rightarrow CO_2 + H_2. \quad \text{II.}$$

The $CO_2$ is scrubbed from the gaseous product leaving only hydrogen. The hydrogen is admixed with gaseous products of equation I to produce a gas having desired ratio of hydrogen to carbon monoxide from which methanol and similar products are synthesized catalytically. Preferably, the gas having the desired ratio of hydrogen to carbon monoxide is produced during the coal pyrolysis, and more preferably by hydropyrolysis. In accordance with this aspect of the instant invention, the raw pyrolysis gas which contains water vapor is subjected to sulfur and nitrogen removal as previously disclosed. The $H_2$ and CO are then separated by, for example, cryogenic means and converted to methane. The methane, ethane and higher hydrocarbon gases are converted to the alcohols.

In the methanol synthesis plant the respective constituents, such as carbon monoxide and hydrogen, are combined to produce methanol. The synthesis of methanol is described in page 370–398 of vol. 13 of the above referenced Kirk-Othmer Encyclopedia. The carbon monoxide and hydrogen are controlled in a ratio and temperature pressure combination to obtain maximum yields of the methanol fuel product. Other methods for methanol synthesis at lower temperatures and pressures are also known, as for example, the ICI low pressure process as described in "Here's How ICI Synthesizes Methanol at Low Pressure", Oil and Gas Journal, vol. 66, pp. 106–9, Feb. 12, 1968. In accordance with this aspect of the instant invention, the alcohol is used as a portion or substantially all of the liquid phase in the slurry.

The mixing (or slurrying) of the enhanced and/or blended solid particles and the liquid can be accomplished by any well known mixing apparatus in which an organic liquid constituent and a particulate coal char can be mixed together in specific proportion and pumped to a storage tank.

The important aspect of the slurry in the instant application is that it is pumpable and stable. This is accomplished by matching the size of the solid char particle, the viscosity of the liquid phase and the stabilizer. In accordance with the aspect wherein the liquid organic portion is used, preferably, a small percentage by weight, for example from 1% to about 3%, of water is admixed into the slurry. This is especially preferable when surfactants which have hydrophyllic moieties are used. The slurry is preferably agitated or blended to produce a suspensoid which is stable under shear stress, such as pumping through a pipeline.

It will be realized that, in accordance with the instant invention, surfactants, suspension agents, organic constituents and the like may be added depending on the particular application. Certain well known surfactants and stabilizers may be added depending on the viscosity and non-settling characteristics desired. Examples of such substances which are useful in accordance with the instant invention include dry-milled corn flour, gelatinized corn flour, modified cornstarch, cornstarch, modified waxy maize, guar gum, modified guar, polyvinyl carboxylic acid salts, zanthum gum, hydroxyethyl cellulose, carboxymethyl cellulose, polyvinyl alcohol and polyacrylamide. As hereinbefore mentioned, advantageously the admixture of the instant invention demonstrates high fluidity. Thus high Btu per unit volume is obtained with lower viscosities and higher fluidities.

As previously set forth, the sizing and packing of the slurry is particularly important in obtaining a highly loaded, stable, transportable combustion fuel. It has been found advantageous to have greater than about 50% of the solid material smaller than about 100 mesh (Tyler) and over about 80% of that passing mesh size in the range of 300 (Tyler). Preferably, the viscosity of the liquid hydrocarbon fraction is in the range of from 17° API to about 20° API. This will of course depend on the loading and pumping characteristics desired, the stabilizers used, whether coal and/or alcohol are present in the slurry in accordance with the instant invention. The degree API is very important in the end use application, i.e., the external combustion system design. Those oil fired systems designed for "heavier" crudes will tolerate more viscous oils and higher loaded slurries.

The fuel composition of the instant invention can be mobilized or transported by all conventional means used for crude oil transportation, permitting the efficacious foreign export of coal derived fuels which has not heretofore been readily and economically accomplished. For example, the existing pipelines to docks and tanking facilities can readily be utilized. Oil tankers can empty their crude oil load in this country, and be refilled with the particulate char-containing fluidic fuel system of the instant invention which can be exported to other nations, thus improving the balance of payments of this country.

The fuel system of the instant invention can be varied by the use of other than the organic liquid fraction as the slurry medium. In accordance with one variation, the enhanced and/or blended solid is slurried with liquid carbon dioxide to provide a transportation medium for the fuel to its end-use. The solid is then separated from the liquid carbon dioxide by evaporation and injected directly into the combustion chamber of a combustion system in the presence of sufficient oxygen and heat to initiate and sustain combustion. The combustion products are then exhausted from the combustion chamber. In this manner, some or substantially all of the solid can be removed from the slurry and fired directly into solid-fueled combustion devices.

Another embodiment uses water as the transportation medium. In this embodiment, the enhanced and/or blended solid is admixed with water and the aqueous slurry is injected directly into the combustion chamber of a liquid-fueled combustion system. Alternatively, some or substantially all of the solid can be removed from the slurry and fired directly into char- or coal-combustion devices. In another aspect, a portion of the liquid organic fraction can be admixed with the enhanced solid/water liquid phase to enhance the burning characteristics as a fuel for a liquid-fueled combustion device. Preferably, surfactants and suspension agents are used to create a hydrocarbon/water (oil/water) emulsified liquid system.

USE OF FUEL COMPOSITION

When the solid is slurried with the organic liquid, the high BTU, non-polluting, completely combustible fluidic fuel system, upon reaching its ultimate destination, can be employed directly as a substitute for petroleum derived fuels (1) for heating; (2) for power generation; or (3) in mobile combustion units.

Alternatively, the liquid and solid components can be separated so that some to substantially all of the solid portion of the slurry is removed from the slurry medium. After separation, each of the components can be used independently as fuels for different combustion systems. The slurry medium, which is predominantly the liquid organic portion of the mixture, will continue to carry minute, inseparable particles of char and can be used in liquid-fired combustion systems or as a feedstock. It will be realized that the organic liquid portion, when used as a fuel, can be combusted alone or combined with liquid petroleum distillates and/or lower to medium chain alcohols having from 1 to about 15 carbon atoms, such as those produced from grain or biowaste synthesis processes to enhance certain fuel characteristics for a particular application. The separated carbonaceous material can be burned alone or with a mixture of raw coal, upgrade coals, petroleum coke or the like in standard solid-fueled combustion systems. By admixing the char with one or more of these carbonaceous materials, a high quality compliance product can be obtained even if the admixed material is low in BTU and/or high in sulfur.

Likewise, it may be preferred not to slurry all or a substantial portion of the liquid organic fraction. Certain lower boiling fractions such as gasoline and distillates are removed prior to slurrying for use directly as transportation fuels. These fuels are transported in the pipeline by use of plugs and the like to refineries or to end-use combustion devices.

Char- or coal-fired combustion devices, with little or no modification, can burn the enhanced and/or blended carbonaceous material portion of the slurry which serves as the solid component of the fuel system. The solid will typically carry about 10% of the slurry liquid even after separation.

One particularly advantageous aspect of the instant invention relates to the flexibility of the transportable fuel system. The process for making the slurry compositions is internally self-contained, i.e., it uses predominantly the constituents of the coal feedstock, including process heat generated from coal; in most cases requires no external water; and utilizes almost all by-products of the process in the product, thus does not produce any "sludge" or polluting liquors which must be removed. The transportable fuel system can be "blended" or "fine tuned" during the process, prior to transportation or at the end-use facility. The fuel system facilitates transporting coal-derived fuels to both liquid fueled and solid fueled combustion systems as well as providing a useful feedstock. The fuel is uniform and non-polluting. The components can be beneficiated to remove harmful constituents, thus avoiding the $SO_2$ and $NO_x$ pollutants linked with acid rain as well as ash related boiler slagging problems. There is no preclusion against exporting the fuel system and export is easily accomplished using conventional transportation means for liquid fuels. The fuel system utilizes all ranks of coals, including lower ranks and coals not previously thought economically viable.

While the invention has been explained in relation to its preferred embodiment it is understood that various modifications thereof will become apparent to those skilled in the art upon reading the specification and the invention is intended to cover such modifications as fall within the scope of the appended claims.

We claim:

1. A method of generating electrical power in conjunction with production of a fuel product utilizing the pyrolysis of coal comprising the steps of (a) pyrolyzing coal to produce a coal char, an organic material and a hydrogen-rich gas (b) transferring at least a portion of said char, said organic material or said gas or combinations thereof to an electrical generating facility for use as an energy source to power the turbines of said facility;

(c) transferring at least a portion of the waste heat from said electric generating facility for use as at least part of the heat to carry out said pyrolysis step and (d) using at least a portion of said coal char or said organic material or said gas combinations thereof to produce said fuel product.

2. The method of claim 1 wherein said fuel product is a solid, blended fuel produced by admixing at least a portion of said coal char and a carbonaceous material selected from raw coal, coke, upgraded coal, dehydrated low rank coal, petroleum coke, and mixtures thereof.

3. The method of claim 1 wherein said fuel product is an enhanced, solid fuel produced by bringing a carbonaceous material selected from the group consisting of raw coal, coke, upgraded coal, dehydrated low rank coal, petroleum coke, coal char and mixtures thereof, into intimate contact with an amount of said organic material effective to produce an enhanced fuel.

4. The method of claim 1 wherein said fuel product is a completely combustible, fluid fuel system comprising a liquid/solid mixture, including a portion of a particulate carbonaceous material selected from the group consisting of a solid, blended fuel; an enhanced fuel; coal char; and mixtures thereof dispersed in an amount of a liquid organic material effective to produce a transportable composition, wherein said liquid organic fraction is at least partially derived from said pyrolysis or is a lower chain alcohol of from 1 to about 4 carbon atoms, or mixtures thereof.

* * * * *